United States Patent [19]

Cripe et al.

[11] Patent Number: 4,838,443

[45] Date of Patent: Jun. 13, 1989

[54] VACUUM DISCHARGE BIN FOR BULK MATERIALS

[75] Inventors: Gene F. Cripe; Robert W. Luebbe; Andrew W. Snyder, all of Beatrice, Nebr.

[73] Assignee: Thomas Conveyor Company, Fort Worth, Tex.

[21] Appl. No.: 152,150

[22] Filed: Feb. 4, 1988

[51] Int. Cl.[4] ..... B65D 88/54

[52] U.S. Cl. ..... 220/1 B; 220/1.5

[58] Field of Search ..... 220/1 B, 1.5, 5 A, 5 R

[56] References Cited

U.S. PATENT DOCUMENTS

| | | | |
|---|---|---|---|
| 4,138,163 | 2/1979 | Calvert et al. | 220/1.5 |
| 4,157,609 | 6/1979 | Schutz | 220/1.5 |

FOREIGN PATENT DOCUMENTS

| | | | |
|---|---|---|---|
| 1146453 | 11/1957 | France | 220/1.5 |
| 1333895 | 10/1973 | United Kingdom | 220/1.5 |
| 2188360 | 9/1987 | United Kingdom | 220/1.5 |

*Primary Examiner*—Jimmy G. Foster

*Attorney, Agent, or Firm*—Harness, Dickey & Pierce

[57] ABSTRACT

A rectangular bin body having a top wall, front and back walls, side walls and bottom wall with an inlet opening in the top wall and a discharge opening in the front wall at the juncture of the front wall with the bottom wall and one of the side walls. The discharge opening is aligned with an internal corner of the bin at the juncture of the back and bottom walls with the one side wall so that when the bin is tipped upwardly about a generally horizontal axis located to one side of the bin and inclined with respect to the back the one side wall, the internal corner is located at an elevation below the remainder of the interior of the bin. In this position of the bin, the side walls, the back wall and the bottom wall function as a hopper to direct the bin contents to the internal corner so that the entire contents of the bin can be emptied by directing a suction tube inwardly of the bin straight through the discharge opening and into the internal corner. A discharge tube in the interior of the bin aligned with the discharge opening and directed toward the internal corner from which the bin is emptied, facilitates the insertion of the suction tube into the bin and ultimately into the internal corner of the bin from which the contents are removed. A valve assembly in the front wall of the bin enables samples of the bin contents to be removed without fully opening the bin.

2 Claims, 3 Drawing Sheets

VACUUM DISCHARGE BIN FOR BULK MATERIALS

BACKGROUND AND SUMMARY OF THE INVENTION

Large metal bins are commonly used for transporting and storing bulk granular materials which are vacuum discharged from the bin. Examples of bins that are usable for this purpose are shown in U.S. Pat. Nos. 2,648,428, 3,130,855 and 3,647,106, owned by the Assignee of the this application. Good examples of granular materials stored and transported in such bins are granular plastic materials such as polyethelene, polystyrene and PET.

One of the problems with conventional bins or cartons that are used for these purposes is that the bottom walls of the containers are flat for the purpose of achieving maximum volume in the interior of the container and it is difficult to fully evacuate all of the bin contents from such a container. Accordingly, it is an object of the present invention to provide a bin which is constructed to facilitate thorough vacuum discharge of the bin contents without sacrificing any of the interior capacity of the bin.

In the bin of this invention, a hollow body of generally rectangular shape is provided having a top wall, front and back walls, side walls and a bottom wall. An inlet opening is formed in the top wall and a discharge opening is formed in the front wall at the juncture of the front wall with the bottom wall and one of the side walls, the discharge opening being aligned with an internal corner of the bin at the juncture of the back and bottom walls with the one side wall.

As a result, when the bin is tipped upwardly about a generally horizontal axis located to one side of the bin and inclined with respect to the back and side walls the internal corner is located at an elevation below the remainder of the interior of the bin. As the bin is emptied, the bin contents are naturally directed into the internal corner by the bin walls. Thus, a suction tube can be directed inwardly of the bin straight through the discharge opening and into the internal corner for fully emptying such a bin of its contents.

A discharge tube in the bin is positioned so that it is parallel to the bottom wall and located in close proximity to the bottom wall in substantial alignment with the discharge opening and the internal corner. The discharge tube guides the suction tube into position at the internal corner to facilitate emptying of the bin.

The result is a bin which can readily be utilized to store and transport bulk material and which can also be manipulated at the point of use of the stored and transported material to facilitate vacuum discharge of the bin.

Further objects, features and advantages of the invention will be apparent from a consideration of the following description, the appended claims and the accompanying drawing in which:

Figure 2:
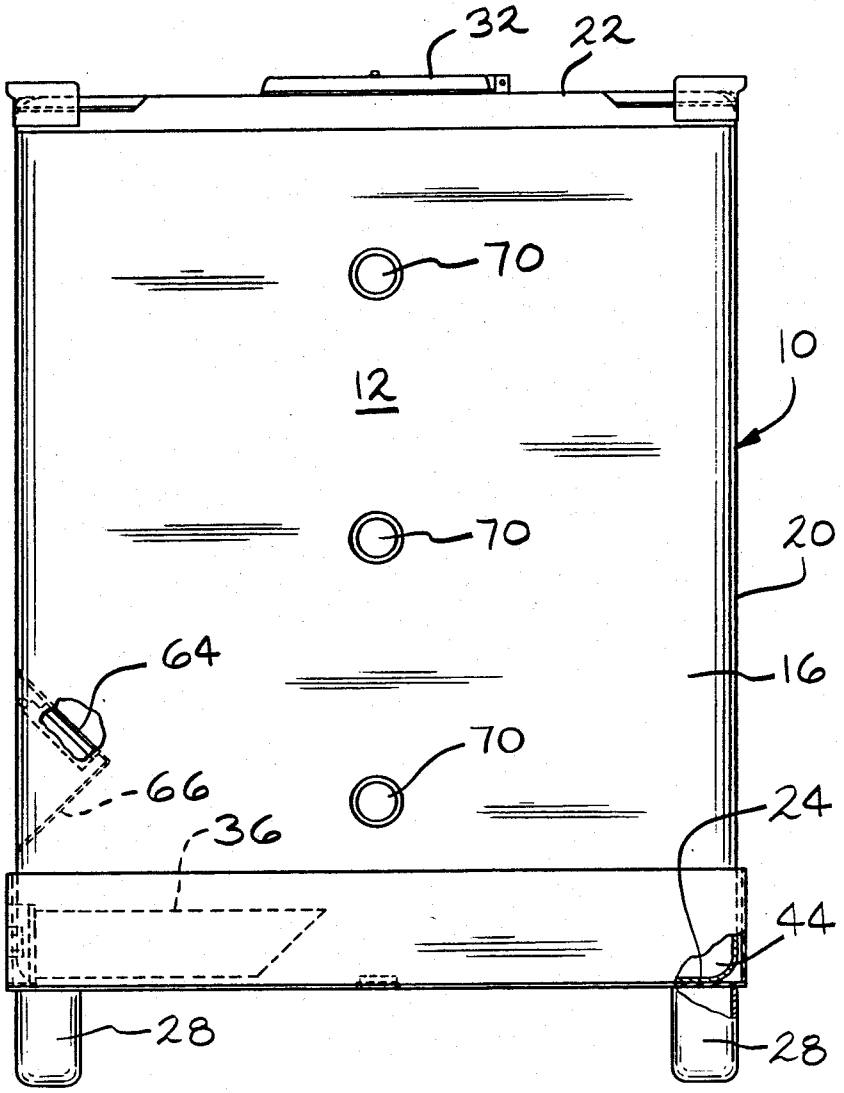
FIG. 2 is a side view of the bin of this invention.
Figure 1:
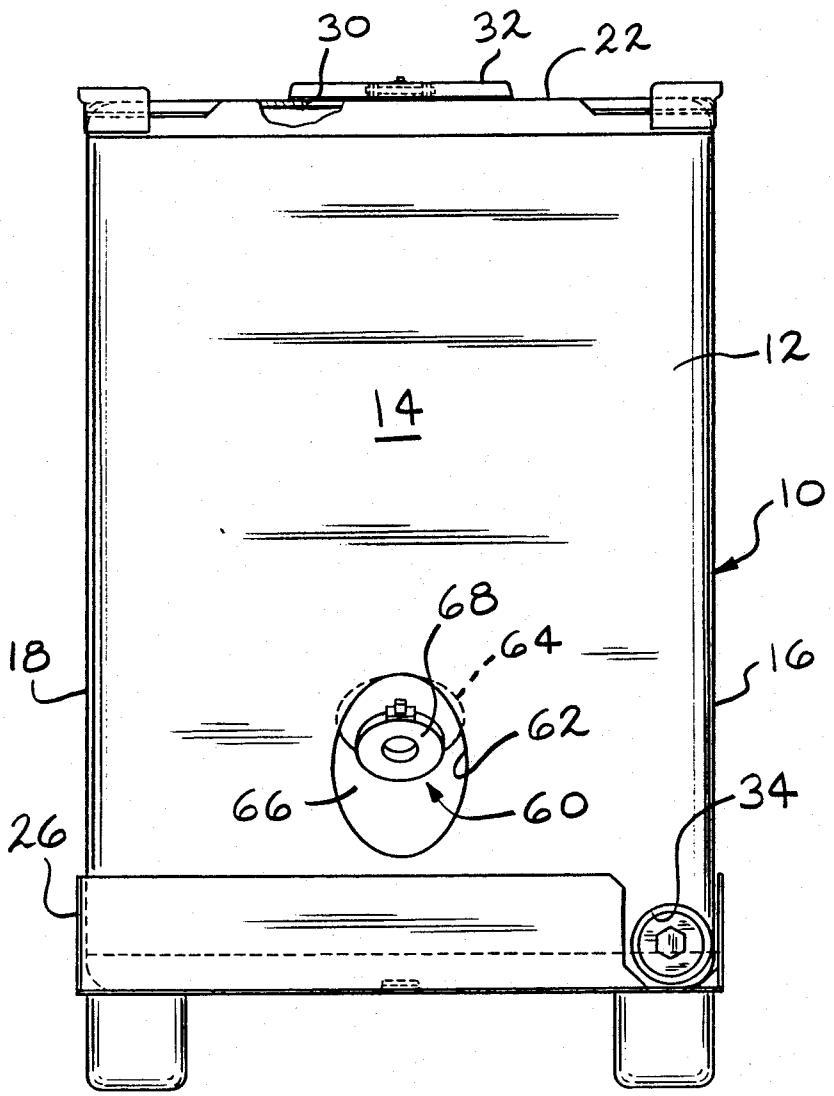
FIG. 1 is a front elevational view of the bin of this invention.
Figure 5:
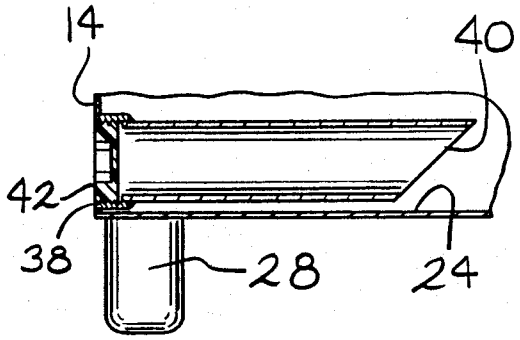
FIG. 5 is a fragmentary detail view of the discharge tube portion of the bin.
Figure 3:
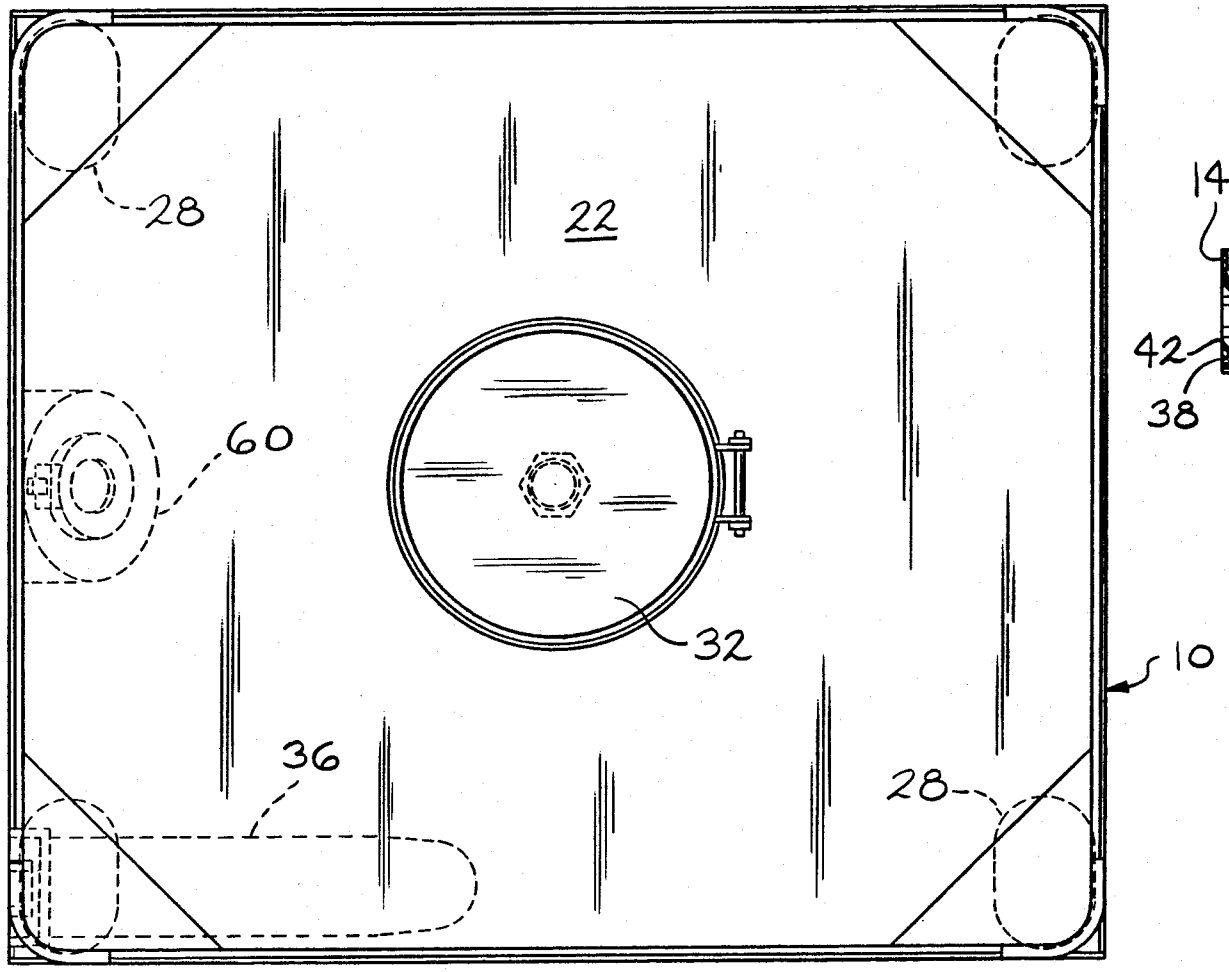
FIG. 3 is a top view of the bin of this invention.

With reference to the drawing, the improved bin of this invention, indicated generally at 10, is shown in FIG. 1 as consisting of an upright body 12 that is of rectangular shape in cross section and has a front wall 14, side walls 16 and 18, a back wall 20, a top wall 22 and a flat bottom wall 24 that is horizontal in the transport and storage positions of the bin shown in FIGS. 1 and 2. In the illustrated embodiment of the invention, the bottom wall 24 is mounted in a rectangular reinforcing cradle 26 provided with downwardly extending supporting legs 28.

The bin 10 has an opening 30 in its top wall 22 which functions as an inlet during filling of the bin and a hinged cover 32 that is operable to close the opening 30 after the bin has been filled. The bin 10 also has a discharge opening 34 in its front wall 14 at a position adjacent the juncture of the front wall 14 with the side wall 16 and the bottom wall 24. An internal tube 36 in the interior of the body 12 is aligned with the opening 34 and has its outer end 38 secured to the front wall 14 at a position in alignment with the discharge opening 34. The inner end 40 of the bin tube 36 is inclined downwardly and forwardly at an angle of about 45° and is open. A removable closure plug 42 normally closes the outer end 38 of the tube 36.

The tube 36 is aligned with the back corner 44 of the bin 10 at the juncture of the rear wall 20 with the side wall 16 and the bottom wall 24.

This arrangement of the tube 36 within the container body 12 facilitates the insertion of a wand or vacuum tube 48 into the interior of the bin through the discharge opening 34 to facilitate emptying of the bin contents. The wand 48 is conventionally connected to a hose 50 which is capable of creating suction in the wand 48 for withdrawing the contents of the bin.

Figure 4:
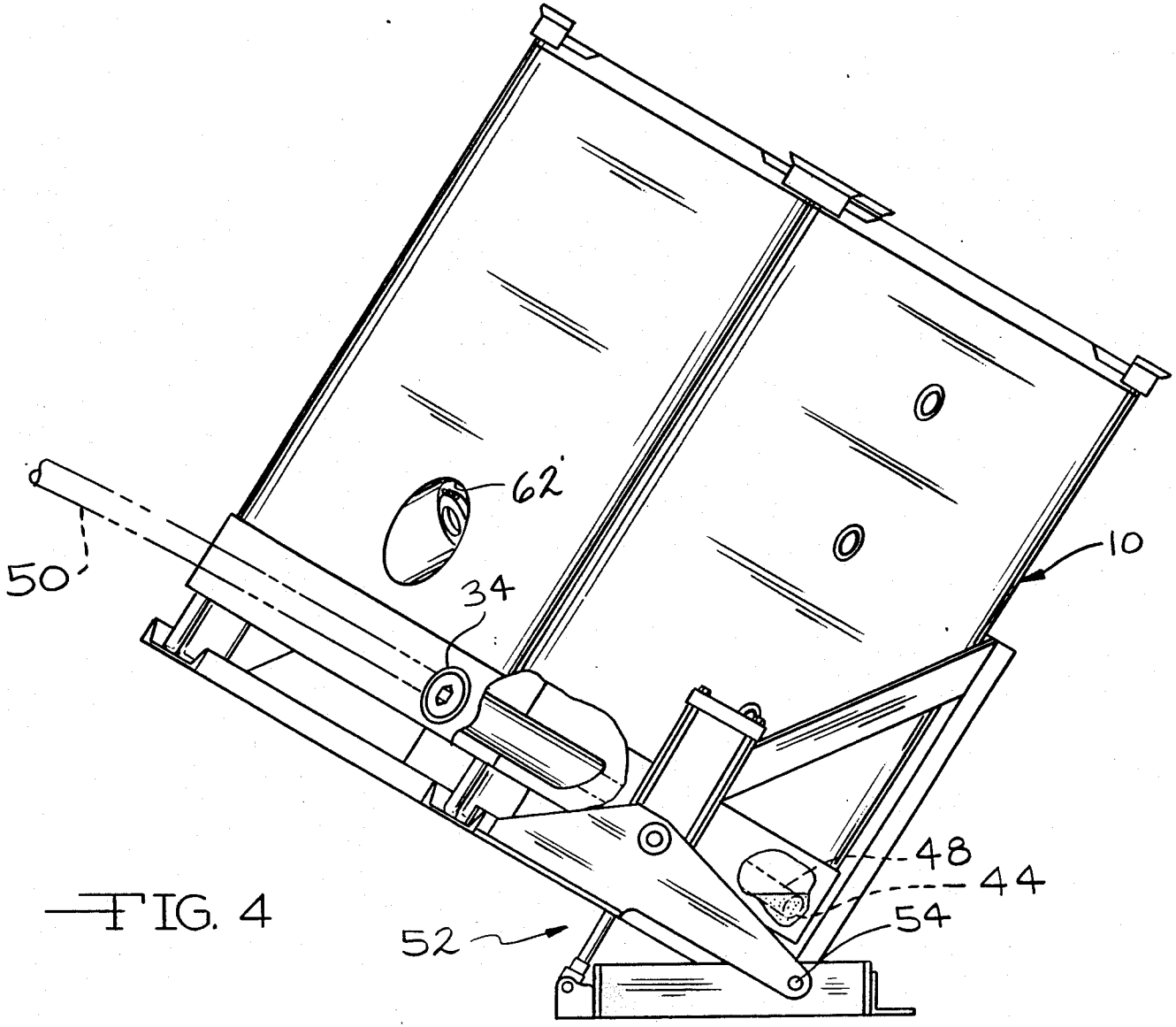
FIG. 4 is a side view of the bin of this invention illustrating the bin mounted on a bin tipping assembly which has operated to move the bin to a discharge position in which one back corner of the bin is at a lower elevation than any other part of the bin.

The above described structure of the bin 10 facilitates mounting of the bin 10 on a tipping assembly 52 (FIG. 4). The apparatus 52 is capable of tipping the bin rearwardly and upwardly about an axis 54 which is generally horizontal and is positioned to one side of the bin 10 at a position adjacent the corner 44. As shown in FIG. 4, this positions the corner 44 at the lowest elevation so that the bin walls function as a hopper to direct the bin contents into the corner 44 so that the bin can be readily emptied through the wand 48 and the tube 50.

The tipping assembly 52 is described in detail in copending application Ser. No. 152,149 filed 2-4-88 assigned to the assignee of this application. The disclosure in said application in incorporated herein by reference.

A conventional butterfly valve assembly 60 is mounted in an elliptical opening 62 in the front wall 14 to enable easy sampling of the bin contents when the bin 10 is in the tipped position illustrated in FIG. 4. As shown in FIG. 2, the movable valve member 64 in the assembly 60 is mounted in a tubular housing 66 which extends upwardly and inwardly in the storage and transport position of the bin. However, when the bin is in its discharge position, the housing 66 is more nearly horizontal so that an access door 68 for the valve assembly 60 can be opened and a sample of the bin contents removed without spillage of the bin contents at the valve assembly 60.

Vertically spaced sightglass assemblies 70 are mounted in the side wall 16 so that the product level in the bin can be monitored.

What is claimed is:

1. A bin for storing and transporting bulk material, said bin comprising a hollow body of generally cubic shape having a top wall, front and back walls, side walls and a bottom wall, means forming an inlet opening in said top wall, means forming a discharge opening in said front wall at the juncture thereof with said bottom wall and one of said side walls, said discharge opening being aligned with an internal corner of said bin at the juncture of said back and bottom walls with said one side wall so that when said bin is tipped upwardly about a generally horizontal axis located to one side of the bin and inclined with respect to said back and one side wall said internal corner is located at an elevation below the remainder of the interior of the bin, said bin being internally structured to provide an unobstructed flow path from all parts of the interior of said bin to said internal corner, a discharge tube in said bin generally parallel to said bottom wall and said one wall and located in close proximity thereto in substantial alignment with said discharge opening, the interior of said bin being unobstructed between said discharge opening and said internal corner so that a suction tube can be directed inwardly of the bin straight through said discharge opening and guided through said discharge tube into said internal corner for fully emptying the bin of its contents.

2. A bin for storing and transporting bulk material, said bin comprising a hollow body of generally cubic shape having a top wall, front and back walls, side walls and a bottom wall, means forming an inlet opening in said top wall, and means forming a discharge opening in said front wall at the juncture thereof with said bottom wall and one of said side walls, said discharge opening being aligned with an internal corner of said bin at the juncture of said back and bottom walls with said one wall so that when said bin is tipped upwardly about a generally horizontal axis located to one side of the bin and inclined with respect to said back and one side wall to locate said internal corner at an elevation below the remainder of the interior of the bin, a suction tube can be directed inwardly of the bin straight through said discharge opening and into said internal corner for fully emptying the bin of its contents and a valve housing secured to said front wall and extending into said bin at an angle such that in said tipped position of said bin said housing extends downwardly into said bin, and a selectively movable valve member in said housing movable to an open position enabling samples of the bin contents to be removed through said housing.

* * * * *